US005542857A

United States Patent [19]

Hume et al.

[11] Patent Number: 5,542,857

[45] Date of Patent: Aug. 6, 1996

[54] LAMPS AND LAMP HOLDERS IN DISPLAY LIGHTING

[75] Inventors: Roger A. Hume; Richard A. Felstead, both of Melton Mowbray; Douglas G. L. Lee, Buckhurst Hill; Lawrence C. Barling, Stevenage; Anthony J. Barrell, Hoddesdon, all of Great Britain

[73] Assignee: General Electric Company, Schenectady, N.Y.

[21] Appl. No.: 107,735

[22] PCT Filed: Aug. 22, 1991

[86] PCT No.: PCT/GB91/01422

§ 371 Date: Dec. 6, 1993

§ 102(e) Date: Dec. 6, 1993

[87] PCT Pub. No.: WO92/14967

PCT Pub. Date: Sep. 3, 1992

(Under 37 CFR 1.47)

[30] Foreign Application Priority Data

Feb. 21, 1991 [GB] United Kingdom ..... 9103623

[51] Int. Cl.[6] ..... H01R 16/625

[52] U.S. Cl. ..... 439/337; 439/241

[58] Field of Search ..... 439/336, 337, 439/346, 671, 226, 227, 240, 241, 673, 220, 230

[56] References Cited

U.S. PATENT DOCUMENTS

| | | | |
|---|---|---|---|
| 1,670,849 | 5/1928 | Doran | 439/336 |
| 2,201,874 | 5/1940 | Wright et al. | 176/32 |
| 2,290,701 | 7/1942 | Mueller | 439/337 |
| 2,339,531 | 4/1946 | Young | 240/78 |
| 2,372,051 | 3/1945 | Beal | 439/337 |
| 2,571,881 | 10/1951 | Howard | 173/328 |
| 4,256,989 | 3/1981 | Trutner et al. | 439/671 |
| 4,565,415 | 1/1986 | Feinberg | 439/24.1 |

FOREIGN PATENT DOCUMENTS

WO90/14703 11/1990 WIPO .

*Primary Examiner*—Gary F. Paumen
*Assistant Examiner*—Hien D. Vu
*Attorney, Agent, or Firm*—George E. Hawranko; Stanley C. Corwin

[57] ABSTRACT

A lamp assembly comprises a lamp having a plurality of terminal pins projecting from a base, and a lamp holder having terminal contacts for engaging the pins. The lamp is first located in the holder by inserting the pins into respective openings in a base of the holder, and the lamp is then rotated relative to the holder to bring a portion of each pin into contact with a respective terminal contact of the holder.

10 Claims, 4 Drawing Sheets

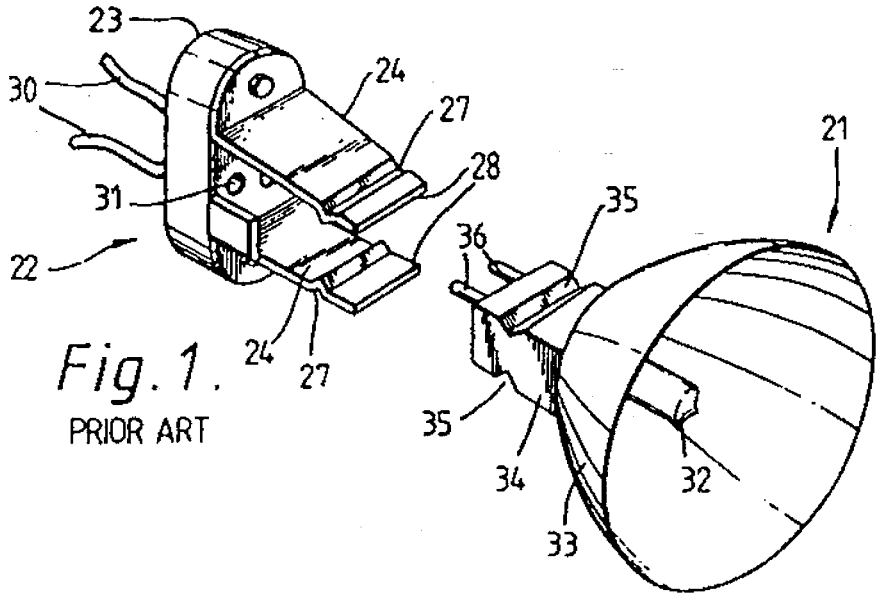
Fig. 1.
PRIOR ART
Fig. 4.
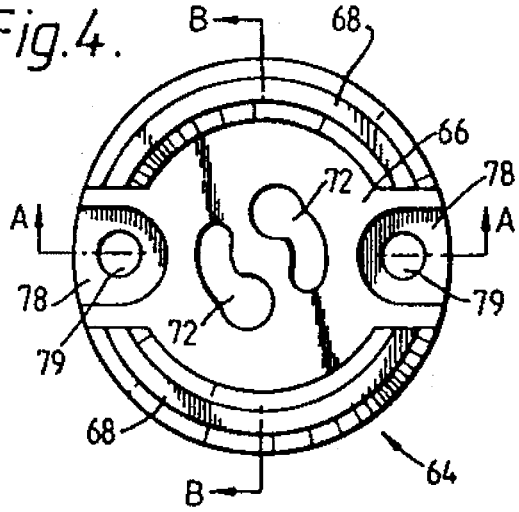
Fig. 5.
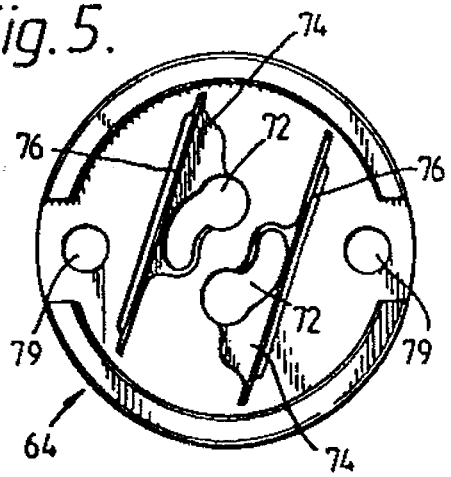
Fig. 6.
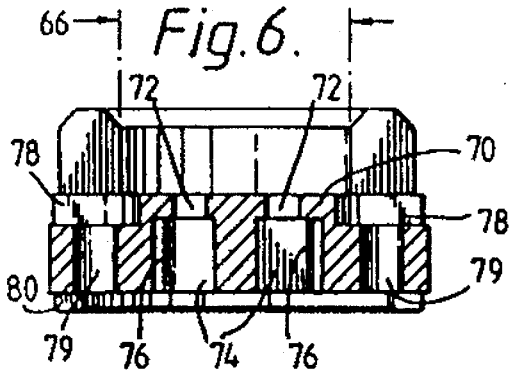
Fig. 7.
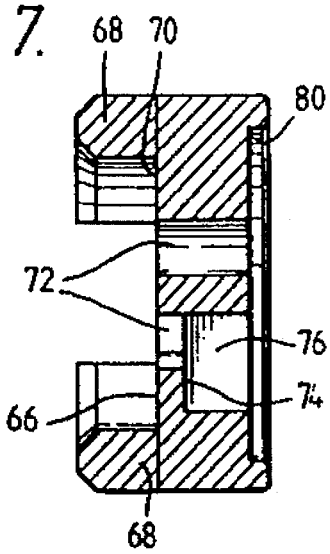

LAMPS AND LAMP HOLDERS IN DISPLAY LIGHTING

The present invention relates to lamp assemblies and more particularly, but not exclusively, to lamp assemblies for photographic and display lighting purposes.

A known lamp assembly for display lighting purposes is shown in FIG. 1. The lamp assembly comprises a reflector lamp 21 and a lamp holder 22.

The lamp holder has a ceramic base 23 with spring arms 24 having kinked portions 27 adjacent each free end 28. Lead wires 30 are connected to terminal sockets 31.

The reflector lamp 21 has a bulb 32 set in the reflector 33. A stem 34 has opposed grooves 35 complementary to the ridges 27 in arms 24. Terminal pins 36 protrude from the bottom of the stem 34. The lamp 21 is fitted in the lamp 22 by locating the ridged portions 27 of the spring arms 24 within the corresponding grooves 35. The pins 36 then locate in the terminal sockets 31.

Display lamps like that described above are often attached to ceilings and their installation and/or replacement can present difficulties. This is because such display lamps are relatively small in size and so it can be difficult for a person to obtain a firm grip on the lamp to pull the lamp away from its holder against the strong spring holding force. This may be a particular problem if the person replacing the lamp is standing on a ladder. Further difficulties arise by virtue of the use of thin terminal pins, these pins may become bent or broken during a replacement operation by the lamp installer. Installation may also be hampered if there is limited accessibility to the lamp fitting.

An object of the present invention is to provide a lamp assembly having a design which enables the lamp to be more easily installed and/or replaced.

In accordance with one aspect of the present invention, there is provided a lamp assembly comprising a lamp having a plurality of terminal pins projecting from a base, and a lamp holder having terminal contacts for engaging the pins characterised in that the lamp is first located in the holder by inserting the pins into respective openings in a base of the holder, and the lamp is then rotated relative to the holder to bring a portion of each pin into contact with a respective terminal contact of the holder.

According to a further aspect of the invention, there is provided a lamp assembly comprising a lamp having a plurality of terminal connections projecting from a stem, and a lamp holder adapted to receive the terminal connections, characterised in that the stem locates in a cylindrical recess in the holder to constrain lateral movement of the lamp relative to the holder, and the base of the recess has slots for receiving the terminal connections, the width of each slot varying along its length whereby an enlarged end portion of each terminal connection is inserted through a wide portion of the respective slot and is then rotated into a locking position beneath a narrow portion of the slot so that a shoulder of the enlarged portion rests against the underneath surface of the base to constrain longitudinal movement of the lamp relative to the older.

The lamp may be provided, if desired, with a reflector within which the lamp bulb is secured.

The invention will now be described by way of example only and with reference to the accompanying drawings in which:

FIG. 1 is a perspective view of a prior art lamp assembly as discussed hereinbefore;

FIG. 4 is a top view of a holder for the lamp of FIG. 2;

Figure 2:
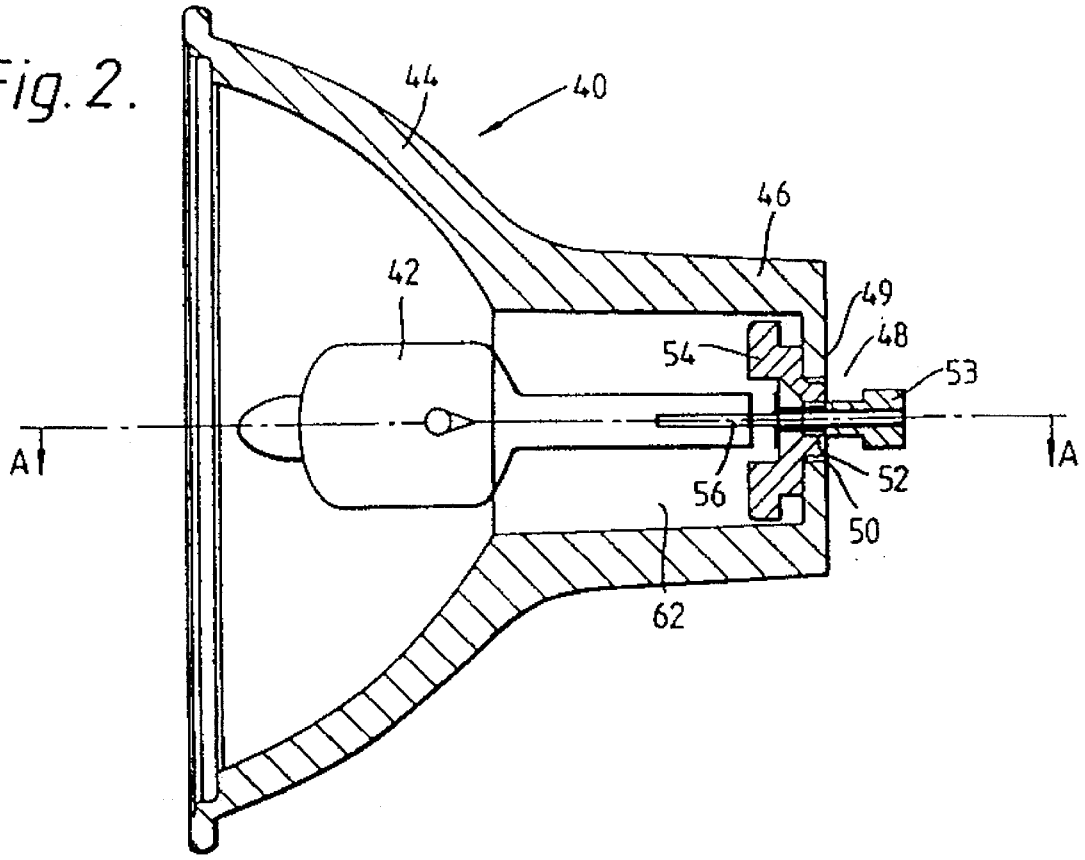
FIG. 2 is a section through a lamp forming part of an assembly according to the invention.
Figure 3:
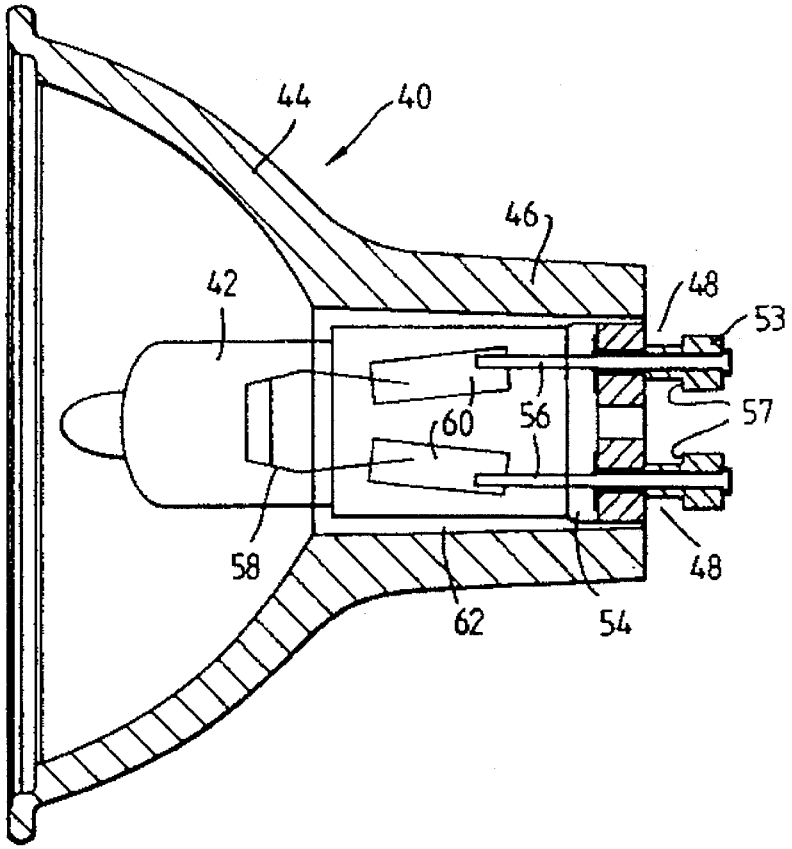
FIG. 3 is a section through the lamp taken along line AA in FIG. 2.
Figure 5A:
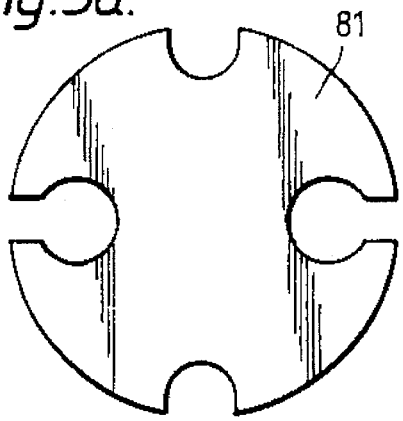
FIG. 5 is a bottom view of the lamp holder with its insulating cover removed.
Figure 8A:
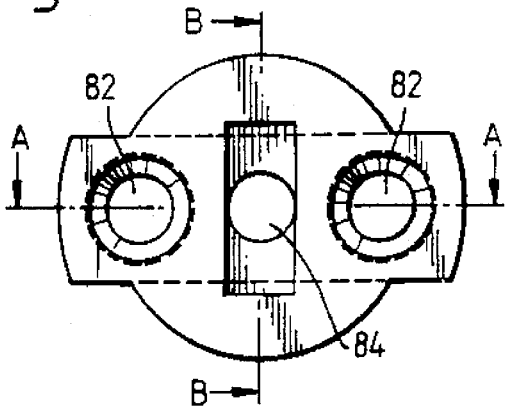
Figure 8B:
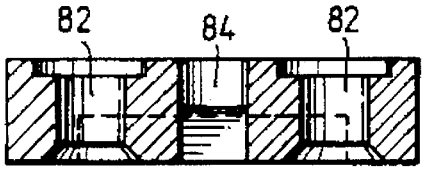
Figure 8C:
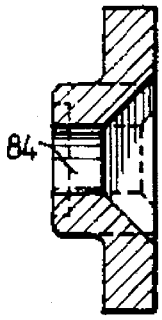

FIG. 5*a* is a plan view of the insulation cover;

FIG. 6 is a section through the lamp holder taken along line AA of FIG. 4;

FIG. 7 is a section through the lamp holder taken along the line BB of FIG. 4;

FIGS. 8*a*, 8*b* and 8*c* show details of a ceramic insert shown in FIGS. 2 and 3.

Figure 9:
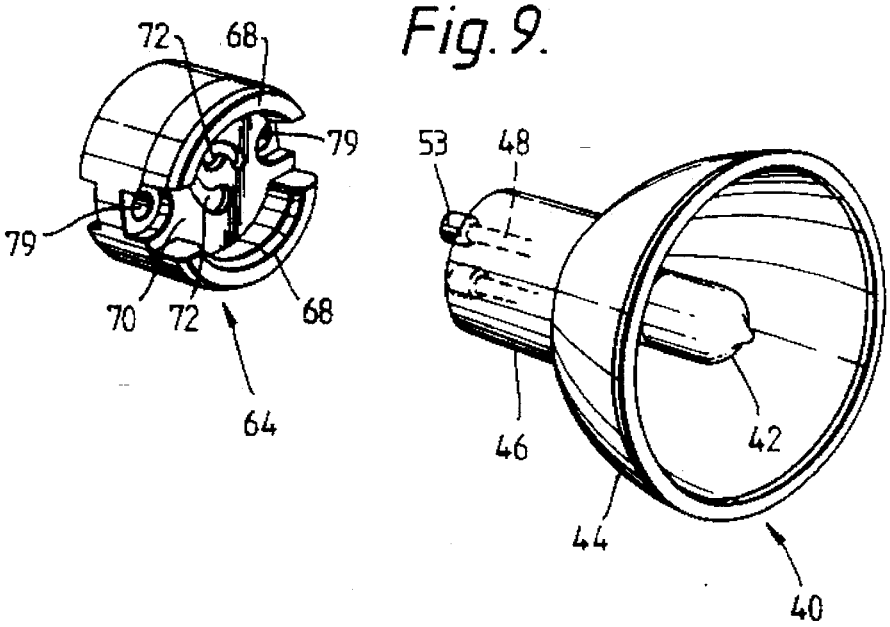

FIG. 9 is a perspective view of the lamp and lamp holder (unassembled); and

Figure 10A:
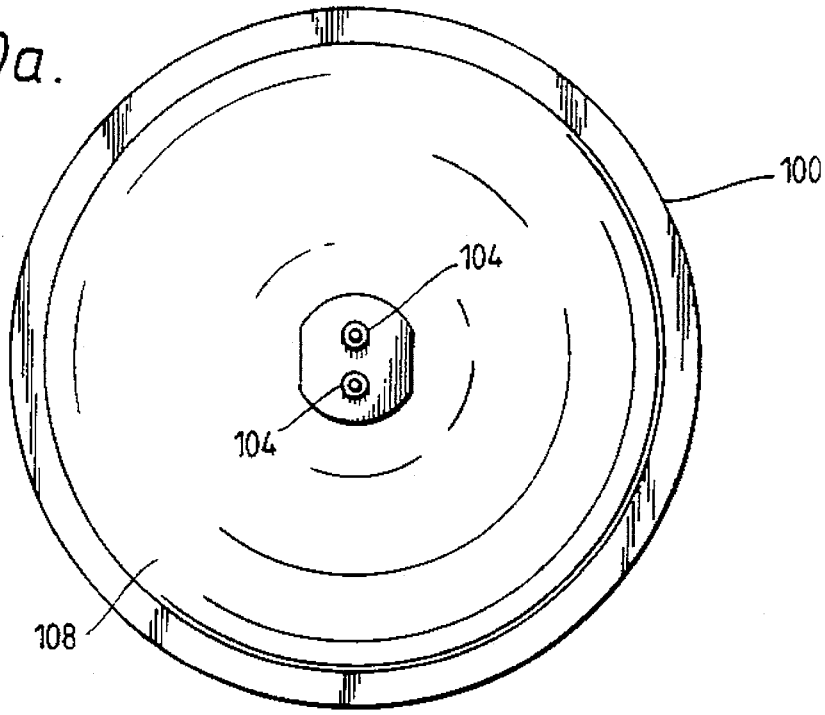

FIGS. 10*a, b, c, d,* illustrate another design of lamp that can be used in an embodiment of the invention.

Referring to the drawings, a lamp assembly according to one aspect of the invention comprises a reflector lamp 40 (FIG. 2) which is used in conjunction with a lamp holder 64 (FIG. 4). The reflector lamp 40 has a bulb 42 set into the reflector 44, and includes an integral stem 46 of circular cross-section. For economy the lamp 40 is made from a moulding so that the stem portion 46 is formed with a taper to ease removal from the mould. This taper is shown in FIGS. 2 and 3 to be approximately 3 degrees.

The stem 46 has a circular base 49 with a rectangular hole 50 at its centre for receiving a complementary portion 52 of a ceramic insert 54. Two terminal connections, in the form of a pair of sturdy bayonet pins 48, protrude from the bottom of the stem 46 through respective holes 82 in the portion 52. The insert 54 shown in FIGS. 2 and 3 is illustrated in more detail in FIGS. 8*a*, 8*b* and 8*c*. FIGS. 8*b* and 8*c* are cross-sections taken along respective lines AA and BB shown in FIG. 8*a*.

The protruding portion of each pin 48 has an enlarged end portion 53. Each pin 48 is fixed within the stem 46 by the ceramic insert 54, and a portion 56 of each pin 48 extends inwardly of the stem 46. This portion 56 is electrically coupled to the filament 58 of the bulb 42 by a respective molybdenum contact 60. The bulb 42 is itself held within the stem 46 by cement or by a cylindrical ceramic plug 62.

Referring now to FIGS. 4 to 7, and FIG. 9, the body of the lamp holder 64 has a cylindrical recess 66 for receiving the stem 46 with a close fit so that the lamp 40 is constrained from transverse movement relative to the lamp holder 64. The base 70 of the recess 66 has two "keyhole" slots 72 for receiving the protruding ends of the terminal pins 48, each slot having a width which varies along its length. A wide portion of the slot 72 is complementary to the enlarged portion 53 of the terminal pins 48 thereby enabling the enlarged portions 53 to pass through the slots 72. After passage through the slots, the enlarged portions 53 can be rotated with respect to the lamp holder 64 so that an annular shoulder 57 (FIG. 3) of the enlarged portion 53 lies beneath a narrow section of the slot 72 and engages the underneath surface of the base 70 thereby constraining the lamp 40 from longitudinal movement relative to the lamp holder 64.

Two elongate resilient metal strips 76 are retained within respective cavities 74 in the body of the holder 64, the bottom edge of each strip 76 extending transversely across the underneath surface of the holder as best shown in FIG. 5. Each cavity 74 has narrow slotted ends for capturing the respective ends of the spring metal strips 76. At the center portion of the cavities 74 along the sides of the respective metal strips 76, a space is provided as seen in FIG. 5. This space allows for the resilient metal strips 76 to deflect outwardly when the enlarged portions 53 are moved toward the locked position at the narrow end of the slots 72.

The metal strips 76 serve as terminal contacts and are resiliently retained in the respective cavities 74 such that a portion of each strip lies adjacent the narrow portion of the respective slot 72. In this manner, since the slots 72 open into the cavities 74, the enlarged end portions 53 of the pins 48 tangentially engage the terminal contacts 76 after the pins have been rotated into their locking position as described above.

As is evident from the drawings, particularly FIGS. 5 and 6, as each pin 48 is rotated into its locking position, the enlarged end portions 53 will first engage the respective contact strips 76 before the pin reaches the end of the narrow portion of the slot 72. Accordingly, the strip 76 is deflected against its resilient bias out of the path of the pin. Furthermore, as the pin 48 continues to rotate toward the closed end of the slot 72, it begins to move away from the contact strip 76 so that the strip will tend to resume its straight non-deflected position (shown in FIG. 5) while retaining contact with the enlarged end portion of the pin. This assists the locking action.

The base 70 is also provided with an opposing pair of stepped recesses 78 each of which is provided with a respective hole 79 for mounting the lamp holder 64 to a structure, such as a ceiling, by suitable fixing means.

The bottom portion of the lamp holder 64 containing the cavities 74 has a rebate 80 for receiving an insulating cover 81 (FIG. 5A) made from sheet material such as mica.

The embodiment described above provides a lamp assembly in which lamp installation involves a "twist and lock" operation in the sense that installation requires only a twist action of the lamp in its holder thereby eliminating the need for any insertion force. It is believed that this is a radical step forward in lamp development since the design of the lamp base and its respective lamp holder allows the lamp terminal pins to be self-seeking naturally locking into the lamp holder.

The large diameter of the lamp pins improves mechanical retention therefore eliminating the need for external spring clips as well as giving better electrical contact minimising the possibility of arcing. In addition, their sturdy structure reduces the possibility of the pins becoming bent during installation.

The combination of features in the above embodiment offers the lighting specialist greater assurance that no electrical contact is achieved on initial insertion. This gives a higher degree of security compared with traditional standard bayonet cad arrangements where electrical contact is possible before the lamp is pushed fully into the lamp holder.

Although the invention has been described above with reference to a specific embodiment, it will be appreciated that the design of the lamp may take a variety of forms, one of which is shown for example in FIGS. 10*a* to 10*d*.

Figure 10B:
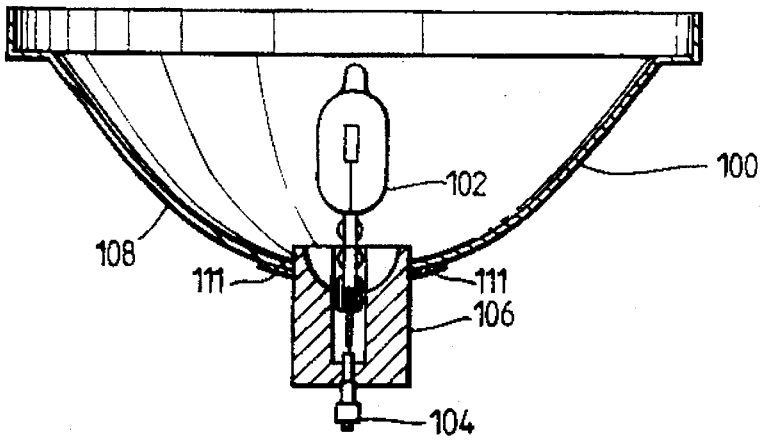
Figure 10C:
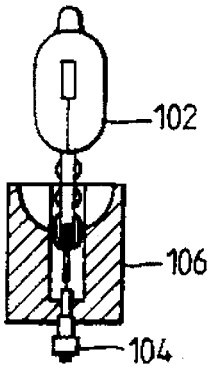
Figure 10D:
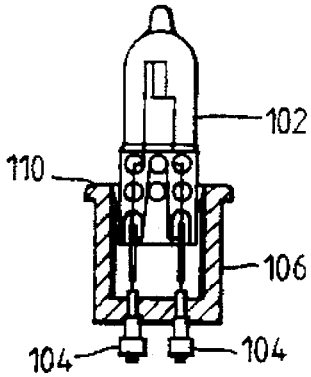

FIG. 10*a* is a bottom view of the lamp 100 which is also shown in section in FIG. 10*b*. The lamp contains a lamp capsule 102 sections through which are shown in FIGS. 10*c* and 10*d*. The lamp capsule 102 has its terminals embedded within a ceramic stem portion 106 with portions 104 extending outwardly from the base thereof. There is no need for an insert like that described in relation to the previous embodiment. The lamp holder may take the same form as that described above in relation to FIGS. 4 to 7, and FIG. 9 and the assembly with the lamp holder is the same as earlier described. A reflector 108 is provided which locates under an annular shoulder 110.

A metal spring clip 111 may provide additional retention between the ceramic stem 106 and the reflector 108.

The lamp assemblies described above with reference to FIGS. 2 to 10 can be mounted to any suitable support member of a building structure. The lamp assemblies can be adapted for applications to many practical modes for mounting luminaires and further provides for enhanced safety in the installation and maintenance of the mounted lamp assembly.

We claim:

1. A lamp assembly comprising a lamp (40) having a plurality of terminal pins (48) projecting from a base (49), and a lamp holder (64) having terminal contacts (76) for engaging the pins (48), wherein the lamp (40) is first located in the lamp holder (64) by inserting the pins (48) into respective openings (72) in an insulating base (70) of the lamp holder, and the lamp (40) is then rotated relative to the lamp holder (64) to bring an enlarged end portion (53) of each pin (48) into contact with a respective terminal contact (76) of the lamp holder, characterized in that said openings (72) in the insulating base (70) comprise slots, the width of each slot varying along its length whereby the enlarged end portion of each pin (48) is inserted through a wide portion of the respective slot (72) and is then rotated into contact with the respective terminal contact (76) beneath a narrow portion of the slot, each terminal contact (76) comprising a metal strip arranged tangentially to the narrow portion of the slot (72), said metal strip being substantially flat and wherein said metal strip is restrained against movement at both ends thereof.

2. An assembly according to claim 1, wherein said metal strips (76) are retained in respective cavities (74) formed in a bottom portion of the lamp holder (64) beneath the slots (72), said slots connecting with said cavities.

3. An assembly according to claim 1, wherein said metal strip (76) is resilient and has two ends, said metal strip being held at both of said two ends in respective cavities such that an intermediate portion of the metal strip between said two ends is deflected out when the enlarged end portion (53) of the pin (48) is rotated toward a closed end of the narrow portion of the slot (72) while retaining contact with the pin.

4. An assembly according to claim 3, wherein said narrow portion of the slot (72) curves away from the metal strip (76) toward the closed end of the slot whereby, during the rotation of the pin (48), maximum deflection of the metal strip (76) occurs prior to the pin reaching said closed end of the slot.

5. An assembly according to claim 1, wherein each metal strip (76) extends transversely across a bottom surface of the holder (64).

6. An assembly according to claim 5, wherein said bottom surface of the holder (64) having a recess, and an insulating cover (81) of sheet material is fitted within the recess (8).

7. An assembly according to claim 1, wherein said lamp (40) is a reflector lamp and the terminal pins (48) protrude from a stem (46) of the lamp (40), said stem (46) being located in a recess (66) above said base (70) of the holder (64) to constrain lateral movement of the lamp (40) relative to the holder (64).

8. An assembly according to claim 1, wherein said lamp (40) is a reflector lamp and the terminal pins (48) protrude from an end surface (49) of a stem (46) of the lamp, the enlarged end portions (53) of the respective pins (48) having shoulders (57) positioned relative to the end surface (49) such that, as the enlarged end portion (53) is rotated into contact with the metal strip (76) beneath the narrow portion of the respective slot (72), the shoulder (57) is located against an underneath surface of the base (70) to constrain the lamp (40) against longitudinal movement relative to the holder (64).

9. An assembly according to claim 3, wherein each metal strip (76) extends transversely across a bottom surface of the holder (64).

10. An assembly according to claim 2, wherein each of said cavities has narrow slotted ends for capturing ends of said metal strip.

* * * * *